United States Patent [19]

Hsieh

[11] Patent Number: 4,693,163

[45] Date of Patent: Sep. 15, 1987

[54] DRUM HEAD LUG ASSEMBLY

[76] Inventor: Ching L. Hsieh, No. 178, Chung Shan 2nd Road, Lu Chow Hsiang, Taipei Hsien, Taiwan

[21] Appl. No.: 893,199

[22] Filed: Aug. 4, 1986

[51] Int. Cl.[4] ..... G10D 13/02

[52] U.S. Cl. ..... 84/413

[58] Field of Search ..... 84/411–420

[56] References Cited

U.S. PATENT DOCUMENTS 4,570,526 2/1986 Hoshino ..... 84/413
4,583,442 4/1986 Minor ..... 84/413

FOREIGN PATENT DOCUMENTS 66830 5/1948 Denmark ..... 84/413
2075238 11/1981 United Kingdom ..... 84/413
2146161 4/1985 United Kingdom ..... 84/413

*Primary Examiner*—Lawrence R. Franklin
*Attorney, Agent, or Firm*—Poms, Smith, Lande & Rose

[57] ABSTRACT

An instrumental musical drum head lug assembly which has a kidney shaped pivot slot on the fastener portion. The pivot slot allows a dowel to be released by turning the securement bolt only a few turns. The pivot slot is wider than the diameter of the dowel, thereby allowing the latch to drop as the securement bolt is loosened. Then the lug can be pulled outwards, so as to release the tension on the tension rod. The slot also allows the lug to be opened so as to provide a wide clearance between the lug and the fastener.

1 Claim, 11 Drawing Figures

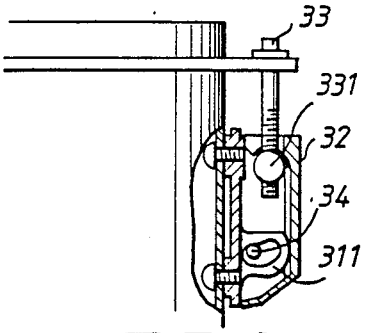
FIG. 3-A
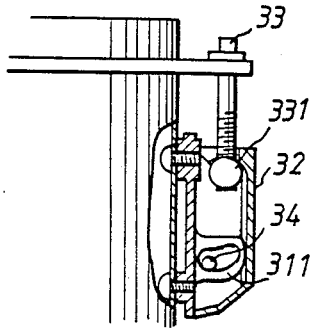
FIG. 3-B
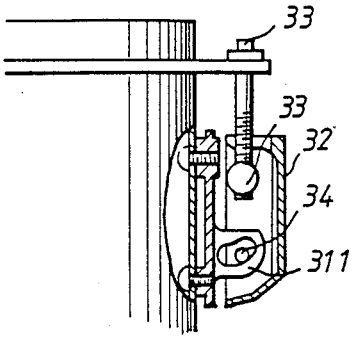
FIG. 3-C
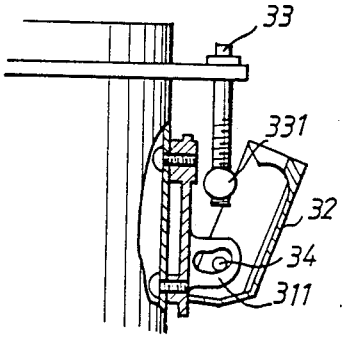
FIG. 3-D
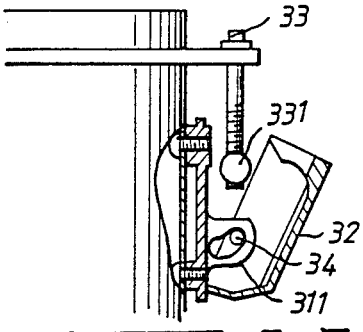
FIG. 3-E

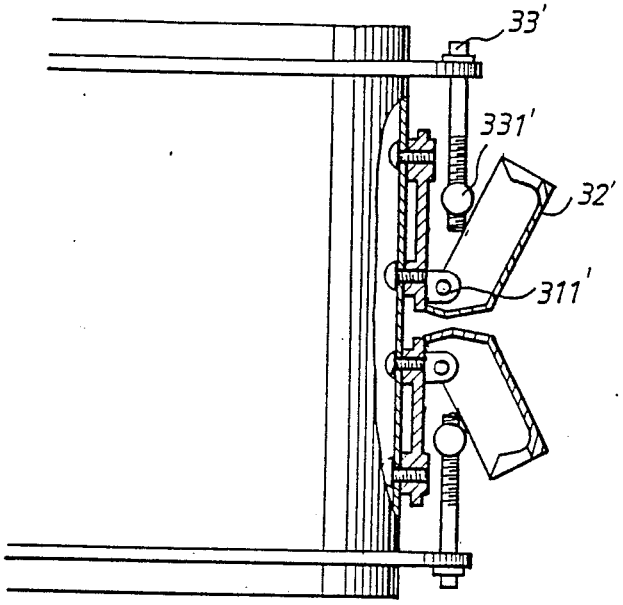
FIG. 4-A PRIOR ART
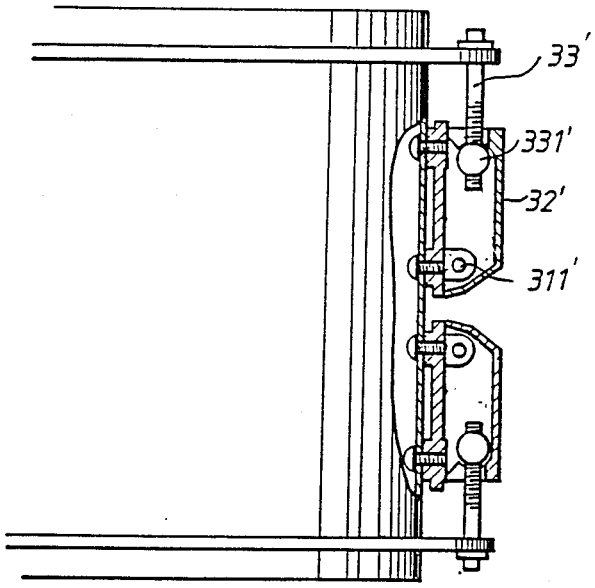
FIG. 4-B PRIOR ART

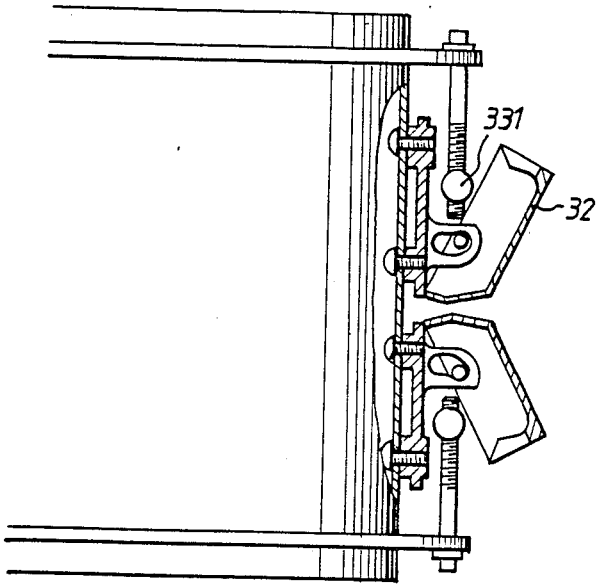
FIG. 5-A
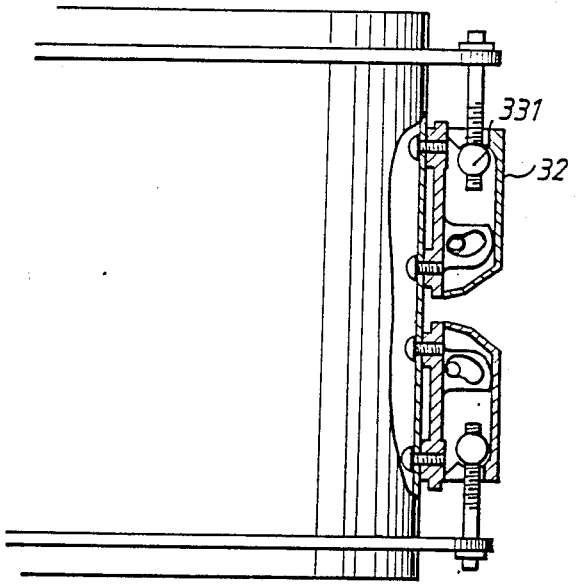
FIG. 5-B

DRUM HEAD LUG ASSEMBLY

BACKGROUND OF THE INVENTION

This invention relates to drum head lug assemblies. In the prior art, drum head lug assemblies were troublesome to replace or adjust because each one of the securement bolts had to be turned many times in order to loosen the latch enough to allow it to be released. Also, previous latches did not offer sufficient clearance for the securement bolt to be manipulated.

It is the purpose of this present invention, therefore, to mitigate and/or obviate the abovementioned drawbacks in the manner set forth in the detailed description of the preferred embodiment.

SUMMARY

A primary objective of this invention is to provide a drum head lug assembly which can be more quickly released or tightened than previous drum head lug assemblies.

Another objective of this invention is to provide a drum head lug assembly which allows greater clearance between the securement bolt and the latch while in disengaged position.

Further objectives and advantages of the present invention will become apparent as the following description proceeds, and the features of novelty which characterize the invention are pointed out with particularity in the claims annexed to and forming a part of this invention.

BRIEF DESCRIPTION OF THE DRAWINGS

FIG. 3-A is a view of the present invention in tightened position;

FIG. 3-B is a view of the present invention in loosened position;

FIG. 3-C is a view of the present invention in released position;

FIG. 3-D is a view of the present invention in disengaged position;

FIG. 3-E is a view of the present invention in cleared position;

FIG. 4-A is a side, partial cutaway view of prior art of a drum head lug assembly in disengaged position;

FIG. 4-B is a side, partial cutaway view of prior art of a drum head lug assembly in tightened position;

FIG. 5-A is a side, partial cutaway view of the present invention in disengaged position;

FIG. 5-B is a side, partial cutaway view of the present invention in engaged position.

DETAILED DESCRIPTION OF THE PREFERRED EMBODIMENT

Figure 1:
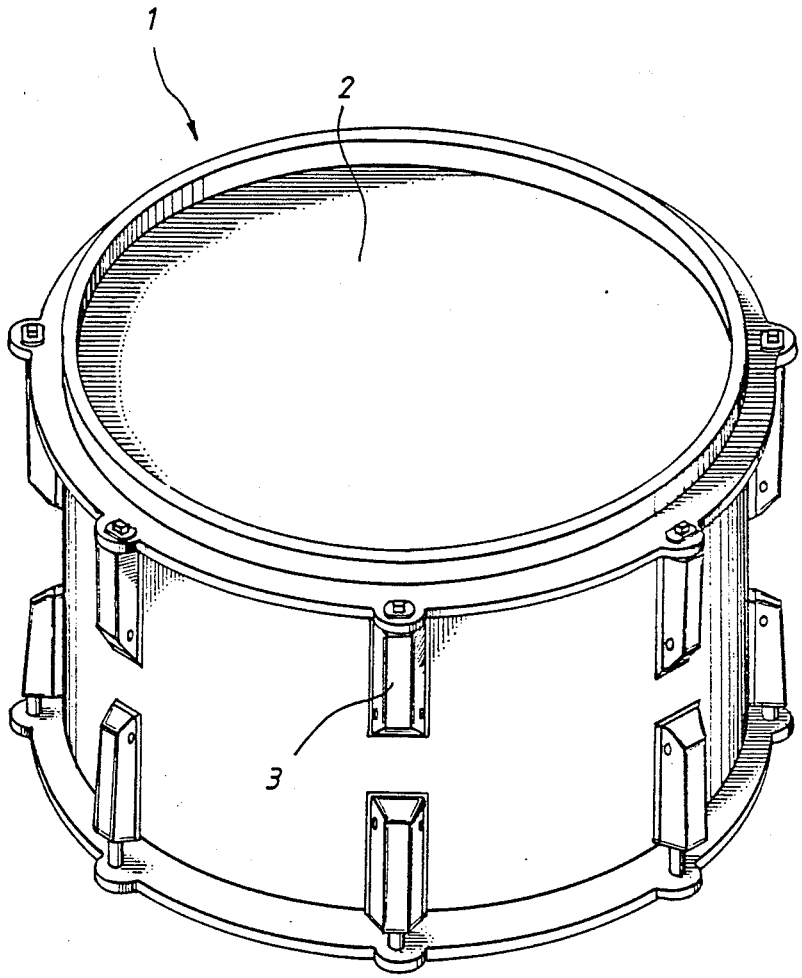
FIG. 1 is a view of a drum using the drum head lug assemblies of the present invention.

Referring to FIG. 1, it can be seen that the lug assembly 3 of the present invention does not alter the outer appearance of a drum 1.

Figure 2:
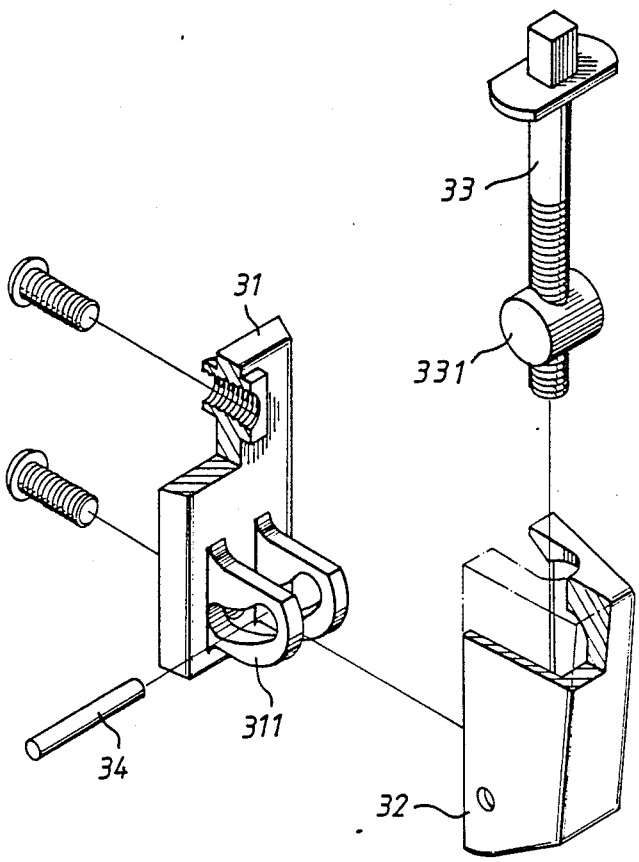
FIG. 2 is an exploded view of the present invention.

Referring to FIG. 2, an exploded view of the present invention can be seen. The invention comprises a fastener 31, a lug 32, a tension rod 33, a receiver nut 331, a kidney shaped pivot slot 311, and a dowel 34. The improvement over the prior art is in the pivot slot 311, as will be explained further in the following paragraphs.

Previously, lugs 32' were only rotatable about a hinge 311', as shown in FIG. 4-A (FIG. 4-B shows the prior lug assemblies in closed position). This meant the tension rod 33' had to be loosened until the receiver nut dropped below the catch portion of the lug 32'. Therefore, it was necessary to turn the tension rod 33' many times so that the receiver nut would be lowered enough to allow the lug 32' to be opened. The present invention, however, has a pivot slot 311 which allows much greater flexibility than was previously available, as can be seen from FIG. 3-A to 3-E.

FIG. 3-A shows the lug assembly of the present invention in tightened (normal) position. Note that the dowel 34 is at a first seat at the top of the slot 311. When it is desired to take off or change the head of the drum, the tension rods 33 must all be loosened, as shown in FIG. 3-B, so that the dowel can be slid around the indentation on the top periphery of the slot. Note that the dowel 34 is now touching the lower portion of the pivot slot 311. However, there is still a gap between the dowel 34 and the top of the pivot slot 311. This is because the width of the pivot slot 311 is greater than the diameter of the dowel 34. The first seat is slightly higher than the indentation but lower than a second seat at the other end of the pivot slot 311. Therefore, when the lug 32 is tightened it tends to move towards the first seat rather than towards the indentation. When the tension rod 33 is loosened, the lug 32 drops down with the receiver nut 331. Since the slot 311 is kidney shaped, the lug 32 is easily slipped off the receiver nut 331, as shown in FIG. 3-C thereby releasing any tension on the tension rod 33. Also, since the lug 32 can be pulled upwards and outwards, the tension rod 33 only has to be slightly loosened. The user is spared the inconvenience of turning the screw too many times.

Referring to FIG. 3-D, the present lug assembly is seen in disengaged (open) position. The top of the lug 32 is rotated in clockwise manner so as to allow the tension rod 33 (and the drum head) to be removed. If the lug 32 is pulled to the uppermost corner of the curved slot, then extra clearance is provided between the lug 32 and the fastener 31. FIG. 3-E shows the lug assembly with tension completely relaxed and fully open. Note that the dowel 34 rests on the second seat of the pivot slot 311.

In FIG. 5-A, a set of top and bottom lug assemblies can be seen together. Since the bottom lug assembly is a mirror image of the top lug assembly, its operation will not be further described. FIG. 5-B shows the top and bottom lug assemblies in closed (tightened) position. Note that when the tension rod is tightened, the curved inner portion of the lug engages with and secures with the curved (cylindrical) surface of the receiver nut 331.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. An improved drum head lug assembly, comprising a fastener with pivot slots, a lug, a dowel, a receiver nut, and a tension rod; said improved lug assembly being further characterized in that: said pivot slot has a first and a second seat with an indentation therebetween on the top periphery of said pivot slot, said second seat is higher than said first seat, said indentation is lower than said first seat and wherein the width of said pivot slot is greater than the diameter of said dowel, said dowel connects to said lug, said dowel is slideably moveable in said pivot slot, said lug engages with said receiver nut when said tension rod is tightened, said lug is outwardly pullable so as to release said tension rod after only slightly loosening said tension rod, said lug has an inner curved portion for engaging with said receiving nut, and said receiving nut has a cylindrical exterior onto which said inner curved portion of said lug engages.

* * * * *